US009227701B2

(12) United States Patent
Woldring et al.

(10) Patent No.: US 9,227,701 B2
(45) Date of Patent: Jan. 5, 2016

(54) VESSEL COMPRISING A MOORING CONNECTOR WITH A HEAVE COMPENSATOR

(71) Applicant: Single Buoy Moorings Inc., Marly (CH)

(72) Inventors: Wilhelmus Coenradus Johannes Jozephus Woldring, Rotterdam (NL); Peter Alan Lunde, Cypress, TX (US)

(73) Assignee: SINGLE BUOY MOORINGS INC., Marly (CH)

( * ) Notice: Subject to any disclaimer, the term of this patent is extended or adjusted under 35 U.S.C. 154(b) by 124 days.

(21) Appl. No.: 13/962,460

(22) Filed: Aug. 8, 2013

(65) Prior Publication Data

US 2014/0045394 A1 Feb. 13, 2014

(30) Foreign Application Priority Data

Aug. 10, 2012 (EP) ..... 12180055

(51) Int. Cl.

| | |
|---|---|
| ***B63B 22/02*** | (2006.01) |
| ***B63B 21/20*** | (2006.01) |
| ***B63C 7/02*** | (2006.01) |
| ***B63B 21/50*** | (2006.01) |
| ***B63B 39/00*** | (2006.01) |

(52) U.S. Cl.

CPC ..... *B63B 21/20* (2013.01); *B63B 21/508* (2013.01); *B63B 22/02* (2013.01); *B63B 22/023* (2013.01); *B63B 39/00* (2013.01); *B63C 7/02* (2013.01)

(58) Field of Classification Search

CPC ..... B63B 21/20; B63B 22/02; B63B 21/508; B63B 22/023; B63B 39/00; B63C 7/02

USPC ..... 114/122, 230.12, 230.13, 230.14; 441/3

See application file for complete search history.

(56) References Cited

U.S. PATENT DOCUMENTS

| | | | |
|---|---|---|---|
| 32,578 | A | 6/1861 | Morrison |
| 7,513,208 | B1 | 4/2009 | Seaman et al. |
| 7,614,927 | B2 | 11/2009 | Olsen et al. |
| 2003/0005875 | A1 | 1/2003 | Breivik et al. |

FOREIGN PATENT DOCUMENTS

| | | | |
|---|---|---|---|
| WO | 2006/037964 | A1 | 4/2006 |
| WO | WO 2007145503 | A1 * | 12/2007 |

OTHER PUBLICATIONS

EP search Report, dated Jan. 23, 2013, from corresponding EP application.

* cited by examiner

*Primary Examiner* — Anthony Wiest
(74) *Attorney, Agent, or Firm* — Young & Thompson

(57) ABSTRACT

A vessel has a hull, a contact area at the hull near keel level for attaching to a structure, a lifting device and a lifting cable attached thereto and extending along a heave compensating member. The lifting cable extends along a substantially vertical lifting trajectory to a connect position below keel level. The heave compensating member includes a guide element for guiding the lifting cable and which is connected to a displacement device. The heave compensating member includes a compensator arm with a pivot end pivotally connected to a pivot point on the vessel at a predetermined transverse distance from the lifting trajectory, the cable guide element being attached to a free end of the compensator arm at or near the lifting trajectory, guiding the lifting cable in the direction of the pivot point, the arm being at or near the free end connected to the displacement device.

20 Claims, 9 Drawing Sheets

VESSEL COMPRISING A MOORING CONNECTOR WITH A HEAVE COMPENSATOR

FIELD OF THE INVENTION

The invention relates to a vessel having a hull, a contact area for attaching to a structure, a lifting device on the vessel and a lifting cable attached to the lifting device and extending along a heave compensating member on the vessel and along a substantially vertical lifting trajectory to a connect position below keel level for attaching to the structure, a compensator arm with a pivot end pivotally connected to a pivot point on the vessel at a predetermined transverse distance from the lifting trajectory, a cable guide element being attached to a free end of the compensator arm at or near the lifting trajectory, guiding the lifting cable in the direction of the pivot point, the arm being at or near the free end connected to the displacement device. The invention also relates to a mooring system comprising a submerged mooring structure, and a vessel having a heave compensating system and to a method of mooring such a vessel.

BACKGROUND OF THE INVENTION

Such a vessel is known from US patent application no. 2003/0005875. This document discloses a dynamically positioned vessel moored via a cavity in its hull to a releasable submerged mooring buoy. A hoisting device, comprising an A-frame lowers from the side of the vessel a light-weight pulling line that can be attached to the submerged buoy. At the end of the pulling line a connection unit is attached that can be coupled to the buoy, as well as a hawser extending through the moompool of a turret to a winching device at the top of the turret, on deck of the vessel. When the buoy is coupled to the connection device, the pulling line is released and the buoy is raised by use of the hawser and the winching device to connect to a cavity at the lower end of the turret. The A frame of the hoisting device can be maneuvered via a hydraulic cylinder for proper positioning and the winch carrying the pulling line is heave-compensated. During connection, the winching device may be subject to large forces induces by the heave moion of the vessel and the buoy. The lifting capacity of the known winch at the top of the turret needs to be large, for instance 1000 tons or more, in order to lift the buoy to its locking position in the cavity, and will require significant deck space.

From U.S. Pat. No. 7,614,927 floating production storage and offloading (FPSO) vessel is known, having in its hull a cavity in which a riser supporting buoy is connected to a cylindrical shaft in the vessel. The buoy has positive buoyancy that, in the disconnected state of the buoy, keeps it afloat at a depth below the wave active zone and is connected to a lifting cable that is attached to a winch on the vessel. The lifting cable runs along a pulley and reversing pulley of a hydraulic heave compensator comprising a horizontally placed cylinder situated on deck beside the moonpool. The heave compensator keeps the lifting rope tight, preventing it from going slack when the vessel moves up and down on the waves. The riser supporting buoy is lifted upwards via the winch until it locks into position in the moonpool via guiding and locking arms, while the vessel is kept in position by a dynamic positioning system. The known heave compensator takes up a relatively large deck space. During connecting of the buoy to the locking arms, the known heave compensating system will be deactivated to prevent relative motion of the buoy and the vessel, which may result in large forces acting on the pick up cable and on the winch.

From U.S. Pat. No. 7,513,208 a disconnectable mooring system for offshore structures such as FSO's, FPSO's, LNG regas import terminals or LNG transport vessels is known comprising disconnectable mooring buoy that is provided with a retrieval system and an intermediate buoy support equipment for detachably connecting the buoy to the bottom of a turret assembly that is rotatably positioned in the hull. A pull-in line extends from the buoy to a winch on the vessel, via a hollow bore hydraulic cylinder that comprises a rotatable hydraulic chain jack. The lifting cable near the buoy is formed by a chain section, which engages, when the buoy is pulled upward against the hull, with the hydraulic chain jack. The hydraulic cylinder assembly supports the load of the buoy while the turret assembly is rotated such that the piping on the turret is brought into proper alignment with the risers on the buoy. After alignment, the hydraulic cylinder raises the buoy at least 1 m into a position adjacent to the keel of the vessel where it is locked, after which the buoy is dewatered, the turret-buoy piping is connected and ropes and chains are stored for future buoy disconnection. The known system may during connection of the buoy be subject to large forces acting on the pull-in line caused by heave movements of the vessel.

It is an object of the present invention to provide a vessel having a lifting system, in particular a mooring system, in which a submerged structure can be rapidly connected to the vessel while forces exerted on the lifting cable caused by heave movements are reduced. It is in particular an object to provide a lifting system allowing a transition from motion compensated lifting to a lifting mode exerting a large force in the last part of the lifting trajectory, for instance when the object is raised near to or above water level, or for providing a preload of the structure against the vessel. It is a further object to provide a vessel having a heave compensator of improved design that takes up relatively little deck space and that allows rapid and controlled connection. It is another object of the invention to provide a heave compensator which reduces cable movements during heave compensation and which has an improved efficiency.

SUMMARY OF THE INVENTION

Hereto the vessel according to the invention is characterized in that the lifting trajectory extends through the contact area, the lifting device and the cable being adapted for lifting of the structure to the contact area, the displacement device being arranged substantially in line with the lifting trajectory and being adapted for pivoting the arm up and down during operation of the lifting device for heave compensation and for raising the arm at a stationary lifting device.

The pivot arm provides a heave compensator by moving upwards or downwards while the structure is pulled towards the vessel via the cable by the lifting device, the lifting cable running along the cable guide element. In the heave compensating member according to the invention, no losses occur by the lifting cable passing over the rope sheaves during heave compensation, which results in a more efficient and improved heave compensation performance. Also, less cycle are made by the rope (which can for instance be synthetic or steel wire) during heave compensation, resulting in an improved life time of the lifting cable. The pivoting arm provides a compact heave compensator and does not require a large transverse stroke of the displacement device, hence saving space on the vessel. The small transverse dimensions of the arm allow it to be mounted inside the turret column of the vessel, saving space in the upper turret.

The displacement device according to the invention is attached to the arm near the free end thereof, substantially in line the vertical lifting trajectory, so that no moments are transferred by the displacement device to the vessel during lifting. The compensator arm and guide element can be so dimensioned that during raising and lowering of the compensator arm, the rope is stationary relative to the guide member. This results in reduced heat generation in the lifting wire during heave compensation in synthetic lifting cables, which heat generation is due to multiple bending at the same location of a synthetic rope. Furthermore, the specific design of the arm resulting in a stationary lifting cable during heave compensation allows in the connecting stage of the buoy, when the upper part of the buoy is situated near the free end of the heave compensator arm, to use the arm for pulling the buoy upwards into its final locking position.

The lifting device according to the invention can be used to lift heavy subsea structures from below water level to the vessel, such as diving bells, blow-out preventers (BOP's), templates, manifolds, pumps or other subsea well equipment. In a preferred embodiment, the structure is formed by a mooring structure, the contact area being arranged at the hull near keel level or externally of the hull for attaching the vessel to the mooring structure. The contact area can be formed by a fixed part on the vessel or can be situated on a turret around which the vessel can weathervane. The mooring structure can be a submerged riser supporting buoy, carrying risers that are attached to a subsea hydrocarbon well and anchored to the sea bed via anchor lines including chains, steel or synthetic cables or combinations thereof.

During the first stage of lifting of the mooring structure, the heave compensating force exerted by the displacement device can be relatively low, as the mooring structure is submerged and located at a depth below the wave active zone. When the mooring structure approaches the vessel, the lifting device can be stopped and the mooring structure can be pulled to its final connecting position by pivoting the compensator arm to its upward limit by contraction of the displacement device. As the mooring structure in the connecting phase supports relatively long lengths of anchor lines and risers, and can be situated at least partly above water level, the loads will be relatively high, which high loads can be effectively taken up by the compensator arm and the displacement device. By means of the high forces exerted by the compensator arm, a large preload of the mooring structure against the hull can be applied.

Preferably the lifting capacity of the displacement device is at least 100 ton, preferably at least 1000 ton. The same applies for the lifting cable.

In one embodiment, a second cable guide element is situated near the pivot end of the compensator arm, the lifting cable being guided from the first cable guide element to the second cable guide element.

The vessel according to the invention may comprise an off-shore structure such as an FPSO, FSO, FSRU, a barge or any other offshore structure which needs to be moored to the sea bed in a disconnectable manner via the mooring structure (e.g. a disconnectable catenary anchor leg mooring—CALM—system, for example for arctic or hurricane area's). The mooring structure according the invention may comprise a mooring buoy, anchored to the sea bed. The mooring buoy may carry one or more hydrocarbon product risers, connected to a subsea well. The connect position on the vessel may be formed externally on the hull near keel level or may comprise a cavity in the hull for receiving the mooring structure. The receiving cavity may be comprised in a turret around which the vessel can rotate, the mooring structure being connected to the turret in a fixed orientation. Alternatively, the mooring structure may comprise a central geostationary part connected to the sea bed and a rotating part attached to the central part via bearings, the rotating part being fixedly connected to the hull in the contact area. The lifting cable may comprise steel or synthetic wire rope, a chain section or combinations thereof. The lifting device according to the invention may comprise one or more winches, a hydraulic jacking system or combinations thereof. The displacement device may comprise one or more hydraulic or pneumatic cylinders or an electric displacement device or combinations thereof.

In a preferred embodiment of a vessel according to the invention, a connector is attached to the free end of the arm for engaging with a complementary connector on the mooring structure when it is pulled upward via the lifting cable. By providing a connector at or near the free end of the arm, the weight may be taken off the lifting cable in the final connecting stage by engaging the connector with the buoy. The mechanical connector allows the arm to exert a large lifting force on the buoy, exceeding the maximum load capacity of the lifting cable. The maximum pull-in load for a cable may for instance be a few hundreds of tons, whereas the lifting capacity of the arm and connector may be over a thousand tons. During transfer of the weight of the buoy from the lifting cable to the arm, the heave compensation is still active, the arm and the connector being moved upward or downward by the displacement device. The guide means and compensator arm are dimensioned in such a way that the cable does not move along the guide means on the free end when the arm moves up or down for heave compensation, so that no relative movement between the connectors on the buoy and on the arm occurs during heave compensation. The connector allows controlled mechanical connection of the buoy to the heave compensating system without impact or relative movements.

In a further embodiment of a vessel according to the invention, the displacement device is provided with a displacement control unit operating the displacement device in a heave compensating mode while the buoy is lifted via the lifting cable allowing upward and downward displacement of the pivot arm at relatively low forces and after providing a fixed attachment of the buoy to the arm, operating the displacement device in a connector mode while the lifting device is stationary, moving the displacement device in an upward direction at a relatively large force to move the buoy to a locking position. This "ratcheted" mode of the heave compensating member results in gradual upwards displacement of the buoy in the final coupling stage utilizing the upwards heave movements of the buoy in a controlled manner.

The displacement device may comprise one or more hydraulic cylinders, the rod side of which is connected to the free end of the compensator arm, which cylinders may have a stroke of for instance 4 typically 5 m. The cylinders are controlled by selectively supplying compressed air to the rod side, to have an average position which is situated about the mid-point of the cylinders. When the buoy is lifted, its weight depending from the cylinders increases, so the control unit commands a pressure increase on the cylinders to compensate for the weight increase, for instance by successively connecting compressed gas reservoirs with increasing pressure to the cylinders. In the locking stage, the control unit may command a check valve attached to the rod side of the cylinders to allow one way flow of compressed air into the rod side of the cylinders, until they are completely retracted and the buoy is raised in its uppermost position, in which it is connected. The buoy may be connected in a receiving cavity near the hull, for receiving the mooring structure, via a locking device for locking the mooring structure into the cavity. The passive heave compensating system according to the invention, using accumulators to provide a spring force, can be operated at reduced power.

In an embodiment, a connector may be attached at or near the end of the compensator arm and may comprise locking jaws for fitting around a clamping rod on a mooring structure, the lifting cable passing through the locking jaw to the first guide means.

Alternatively, a connector comprising a chain stopper may be attached to the hull, the lifting cable near the mooring structure being comprised of a chain section for engaging with the chain stopper. During the connecting stage, the chain section of lifting cable is pulled along the chain stopper by the upward movement of the compensator arm, which allows only upward movement, so that the mooring structure is stepwise lifted to its connect position.

BRIEF DESCRIPTION OF THE DRAWINGS

A number of embodiments of a mooring system according to the invention will by way of non-limiting example be explained in detail with reference to the accompanying drawings.

In the drawings.

DETAILED DESCRIPTION OF THE INVENTION

Figure 1:
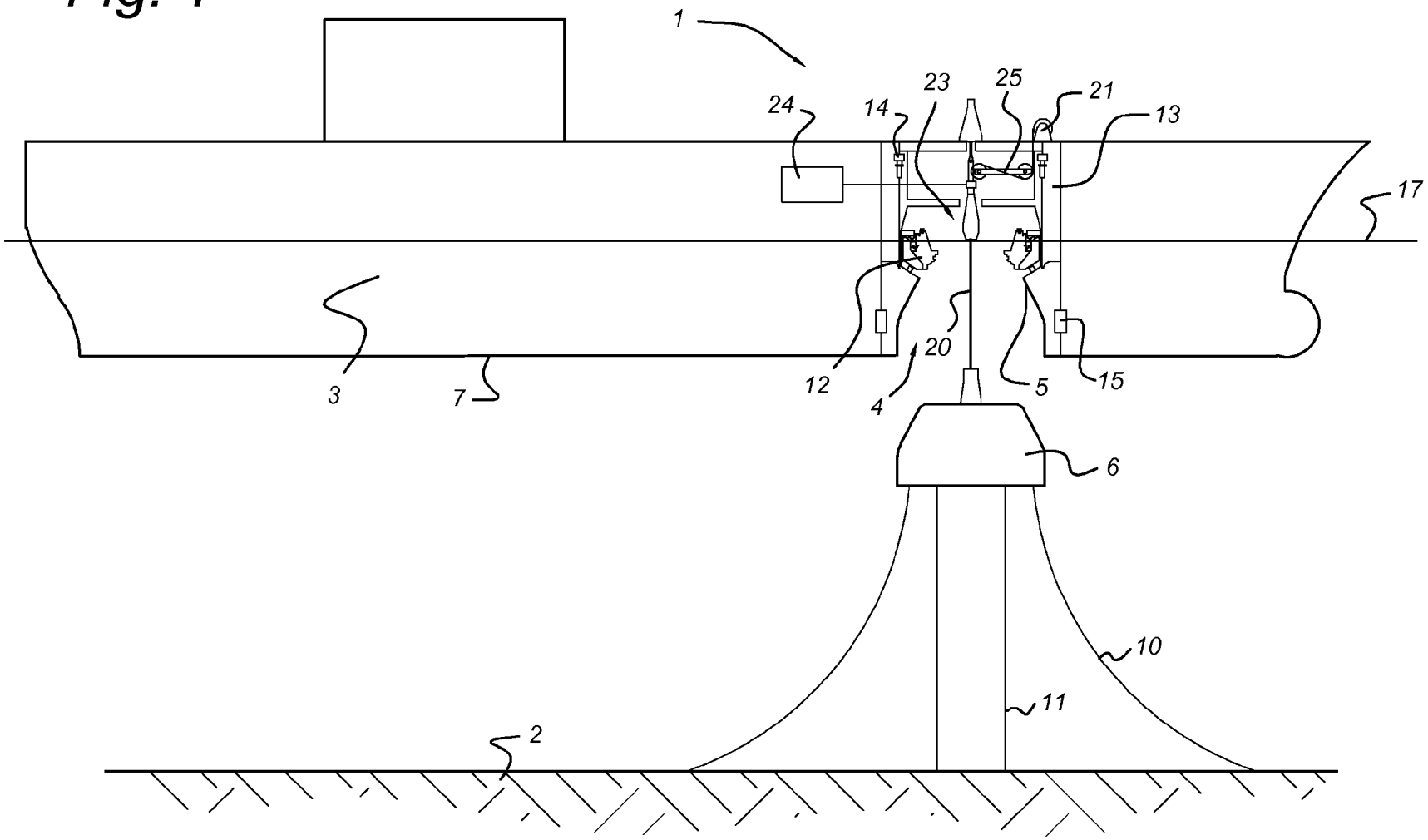
FIG. 1 schematically shows a mooring system according to the present invention.

FIG. 1 shows a vessel 1, such as a FSO, a FPSO, a barge or any other vessel that is to be anchored to the sea bed 2. In the hull 3 of the vessel 1, a receiving cavity 4 defines a contact area 5 for engaging with a mooring buoy 6. The contact area 5, that is situated near keel level 7, may also comprise a differently shaped section of the hull 3, for instance a flat section for abutting against a planar connection surface of the mooring buoy 6, that may have a truncated conical shape, a cylindrical shape or any other suitably shaped contacting interface.

The mooring buoy 6 is anchored to the sea bed 2 via mooring lines 10, that may be formed of catenary chains, synthetic wire ropes, steel cables or combinations thereof. Hydrocarbon product risers 11 extend from a subsea well to the mooring buoy 6 and are to be connected to product piping and a product swivel on the vessel (not shown). The subsea well may be situated for instance 2-3 km below water level 17. The mooring buoy 6 is connected to the vessel via a locking device 12, such as for instance hydraulic clamps, that engage with the buoy and fix its position within the receiving cavity 4. The mooring buoy 6 may be provided with a central geostationary part and an outer rotating part mounted on the central part via bearings, such that the vessel 1, after connecting to the buoy 6, can weathervane around the buoy in dependence on the direction of wind and current. Alternatively, the vessel 1 is provided with a cylindrical turret 13, formed in a vertical shaft that extends through the hull of the vessel, and provided with axial bearings 14 and radial bearings 15. The turret 13 is geostationary, while the hull 3 weathervanes around the turret. Via a torroidal swivel or a pipe swivel assembly, the product piping on the turret is connected to the product piping on the vessel, for allowing relative rotation.

When the vessel 1 is decoupled from the buoy 6, for instance when severe weather conditions require the vessel to be moved, the buoy 6 sinks to a neutral buoyancy level that is below the wave active zone, for instance at a depth of 100 m below water level 17. For reconnecting the mooring buoy 6 to the vessel, it is attached to a lifting cable 20 that is wound around a lifting device, such as a winch 21, on the vessel 1. The lifting cable 20 is guided along a vertical lifting trajectory via a heave compensating member 23 that can pay out or take in the lifting cable 20 to vary its length in dependence of upward and downward heave movements of the vessel 1, in order to avoid excessive loads on the lifting cable 20. A control unit 24, comprising a computer (PLC), controls the response of the heave compensating member 23 and controls the stroke and spring stiffness of the heave compensating member at various distances of the mooring buoy 6 from the vessel 1. Upon lifting of the buoy 6, the weight will increase because of the increasing length of the anchor lines 10 that are lifted from the sea bed and of the risers that are supported by the buoy 6.

Figure 2:
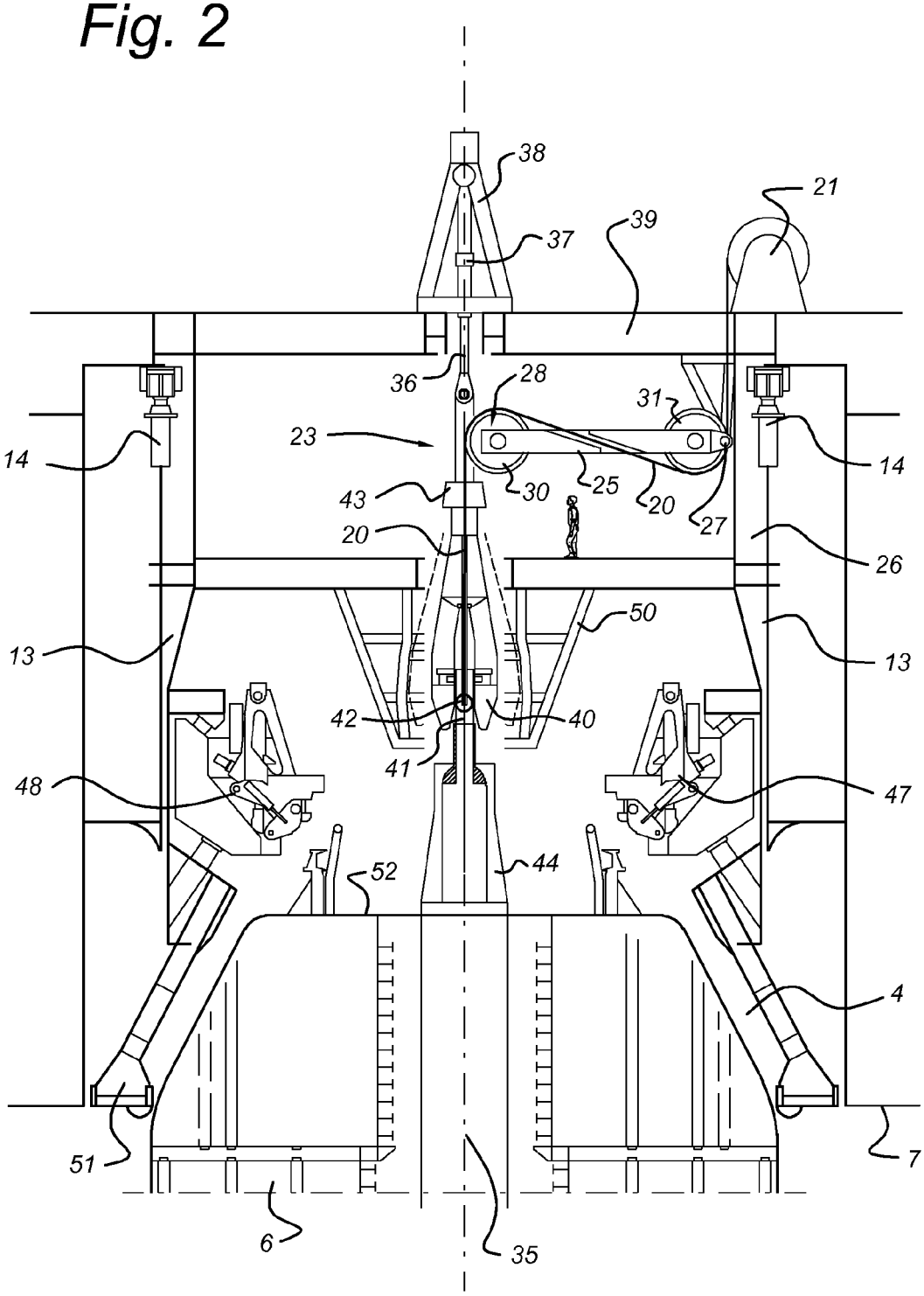
FIG. 2 shows the mooring buoy and heave compensator arm of FIG. 1 on an enlarged scale.

FIG. 2 shows the mooring buoy 6 and heave compensating member 23 on an enlarged scale in a connect position. The heave compensating member 23 comprises a compensator arm in the form of a swing frame 25 that is with a pivot end hingingly connected to a wall 26 of the turret 13 in a pivot connection 27. A free end 28 of the swing frame 25 carries a guide element in the form of a first sheave 30, and at its pivot end a second sheave 31, along which sheaves 30, 31 the lifting cable 20 is guided from the vertical lifting trajectory 35 to the winch 21. The free end 28 of the swing frame 25 is connected to a displacement device in the form of a number, for instance three, hydraulic cylinders 36, 36', 36" that are with their upper ends 37 connected to a support frame 38 that is supported on a deck 39 of the turret 13.

The cylinders 36-36" of the heave compensating member 23 are, in the embodiment shown in FIG. 2, also attached to a clamp 40 which engages in the connect position shown, with a connecting rod 41 of the mooring buoy 6. The connecting rod 41 is retractably placed in a conical housing 44 on a top surface 52 of the buoy 6. The clamp 40 has a hollow core, along the center line of which runs the lifting cable 20 to be attached to the rod 41 in a cable connecting point 42. The clamp 40 is connected to the swing frame 25 via a cardanic hinge 43, so that the buoy can swing in two perpendicular directions as well as rotate around a vertical axis upon connection. In its lifting position, the clamp 40 is engaged with the connecting rod 41, and the weight of the buoy 6 is taken off the lifting cable 20. The last upward stroke of the buoy 6 is made by pivoting the swing frame 25 to its upward position and engaging the clamps 47, 48 with the buoy 6 to fix it into the receiving cavity 4. A guiding cage 50 limits the amplitude of the swinging motion of the buoy 6 hanging on the clamp 40, while fenders 51, which may comprise metal-reinforced elastomeric pads, guide the buoy 6 into the receiving cavity 4 at keel level 7.

The swing frame 25 is capable of pivoting upward and downwards around a substantially horizontal equilibrium position, with a stroke of 2 m in each direction. The geometry of the swing frame 25 and the two sheaves 30, 31 is designed in such a way that during lifting and lowering of the swing frame 25 by pivoting in the pivot connection 27, while the winch 21 is stationary, the lifting cable 20 is stationary on the lifting sheave 30. This is important for the pull-in phase of the buoy. The locking of the buoy can be executed without relative motion between the heave compensated clamp 40 and the connecting rod 41.

Figure 3:
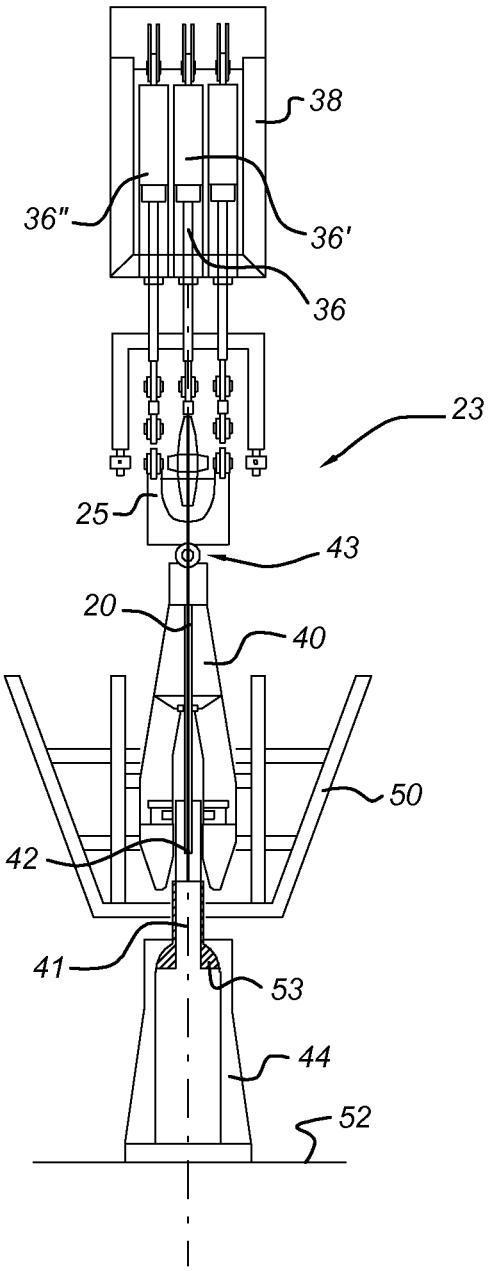
FIG. 3 shows a detailed view of the displacement device in the form of three hydraulic cylinders and a clamp connected near the fee end of the heave compensator arm.

FIG. 3 shows a frontal view of the heave compensating member 23 with the three cylinders 36, 36', 36" connected to the support frame 38. The clamp 40 is connected to the free end 28 of the swing frame 25 via the cardanic hinge 43. The lifting cable 20 passes through the clamp 40 to the connection point 42. The connecting rod 41 is retracted from the housing 44 that projects from the top surface 52 of the buoy. A spherical surface 53 on the end of the connecting rod 41 engages with a complementary surface on the housing 44 to provide a spherical bearing allowing a swinging relative movement of the connecting rod 41 and the clamp 40 on the one hand, and the conical housing 44 on the other hand.

Figure 4:
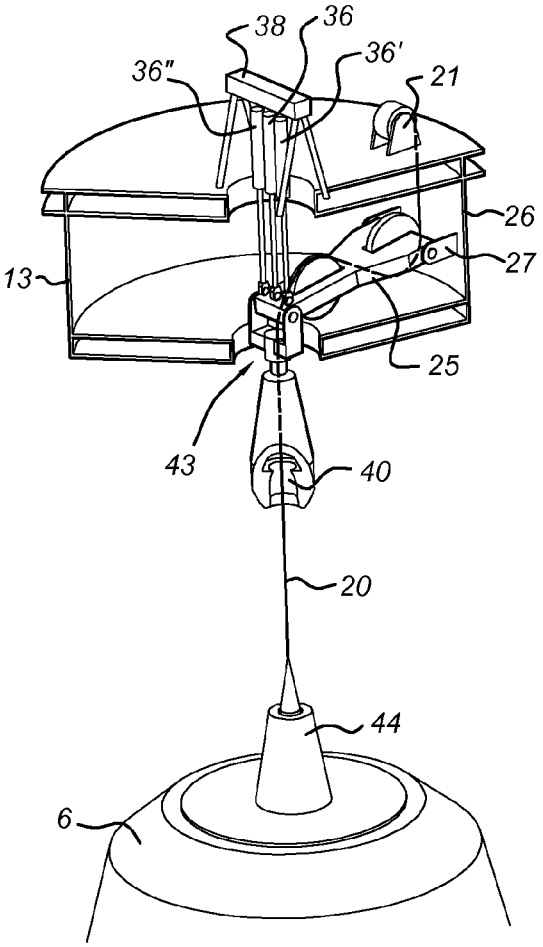
FIG. 4 shows a perspective view of the heave compensating member according to the invention in a first lifting stage in which the buoy is situated at larger water depths.

FIG. 4 shows the buoy 6 at a depth of 100 m below water level, the winch 21 lifting the buoy at a speed of for instance 2 m/min. The static load may be about 0 kN and gradually increases to for instance 4000 kN when the buoy is raised. The pressure inside the cylinders 36-36" is relatively low (e.g. 8 bar) and the compensator arm 25 is maintained on average at a horizontal position with a heave compensation stroke of about 1.5 m in an upwards and in a downwards direction.

Figure 5:
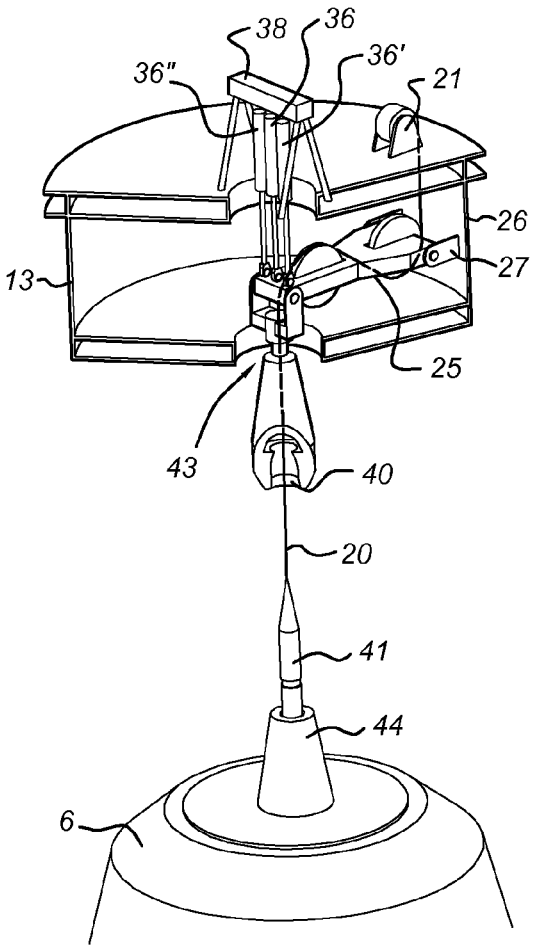
FIG. 5 shows the heave compensating member of FIG. 5 with the mooring buoy approaching the vessel and the connecting rod in an extended state.
Figure 6:
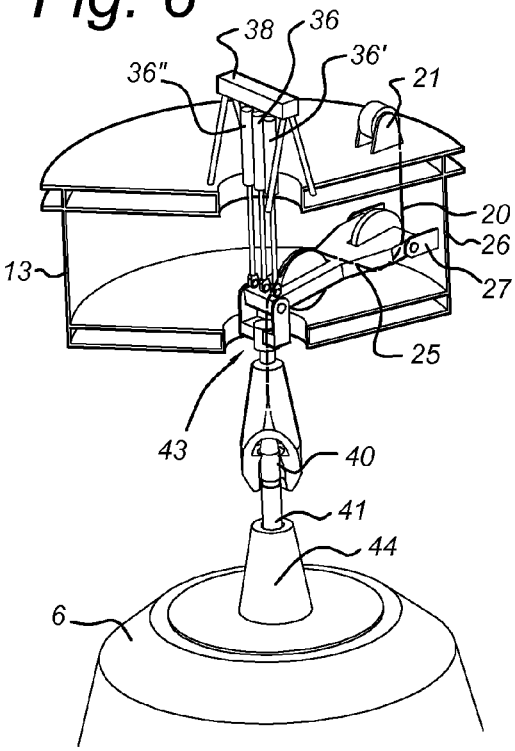
FIG. 6 shows the heave compensator member of FIG. 5, the clamping member being engaged with the connecting rod.
Figure 7:
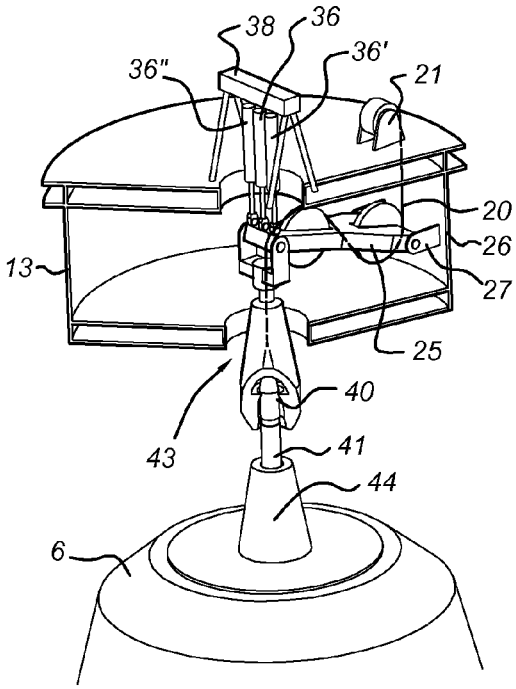
FIG. 7 shows the heave compensator of FIG. 6, in the final connect position in which the heave compensator arm is moved to its most upward position.

FIG. 5 shows that at a depth of the buoy 6 of for instance 100-80 m, the rod 41 is released from the housing 44. In FIG. 6 it can be seen that, while the cylinders 36-36" are in a heave compensating mode, the locking device of the clamp 40 is engaged with the rod 41 and the weight of the buoy 6 is taken off the lifting cable 20. The control unit 24 then switches the cylinders 36-36" into a ratchet mode, in which the arm 25 can only move upwards relative to the hull 3, by means of a non-return valve in the hydraulic circuit of the cylinders 36 (see also FIG. 8). In this way, the buoy 6 can only move upwards and wave action helps raising the buoy 6 to its locking position, In case no wave motion is present, the compensator arm 25 will be raised by the cylinders 36-36" to its locking position, that is shown in FIG. 7, in which position the clamps 47, 48 are engaged to lock the buoy 6 inside the receiving cavity 4. The lifting capacity of the cylinders 36-36" in the final stage may be about 1500 ton.

Figure 8:
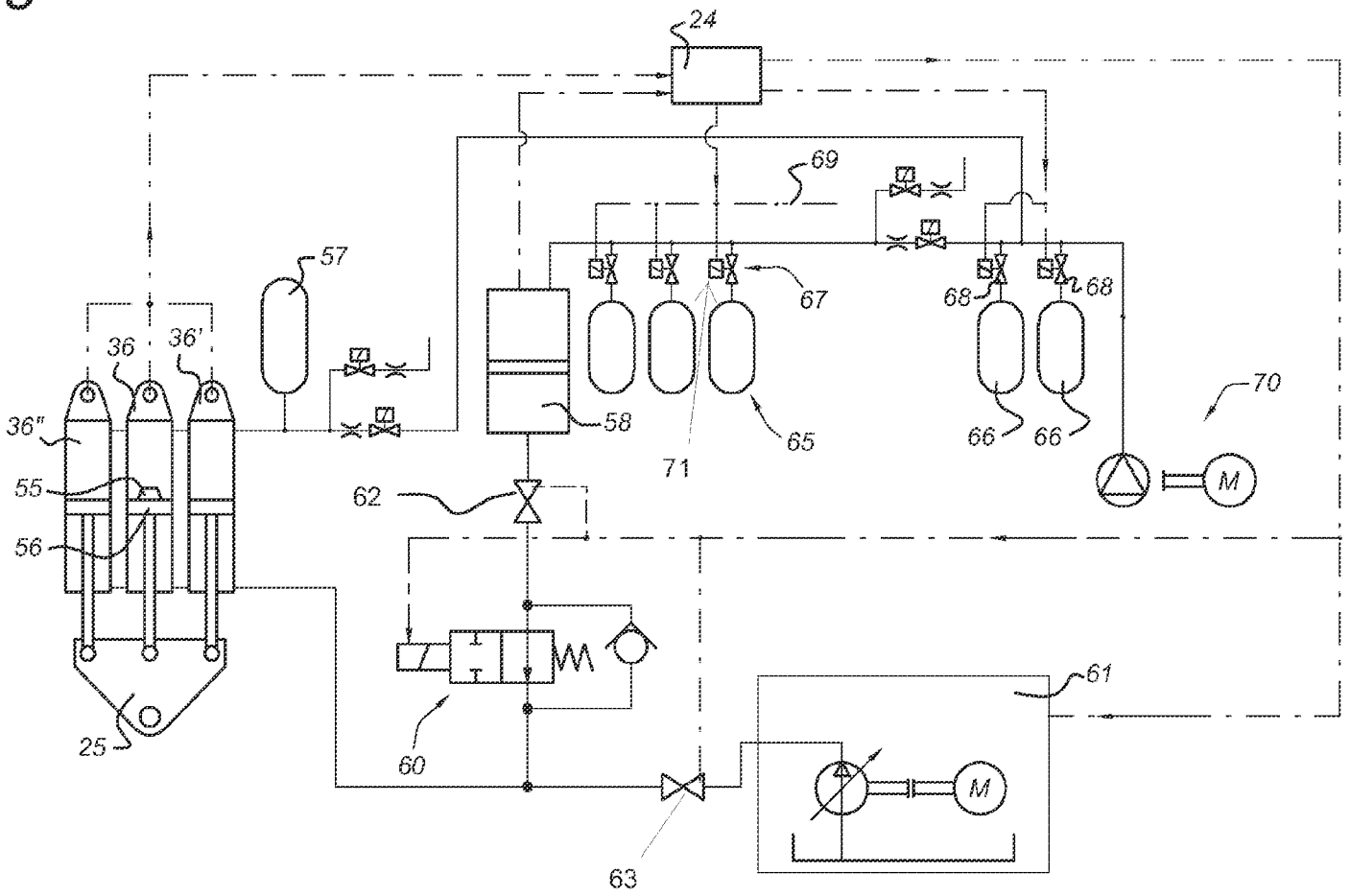
FIG. 8 shows a schematic hydraulic diagram of the heave compensating system and its control according to the invention.

FIG. 8 shows a schematic hydraulic diagram of the heave compensating member 23 according to the invention. The three cylinders 36, 36', 36" have for instance typically a stroke of about 5 m. The mid cylinder 36 has a mechanical cushion 55 at its piston 56 for limiting the upward stroke. The hydraulic cylinders 36, 36', 36" are loaded only under tension, the load hanging from the cylinders so that the cylinder rod diameter can be relatively small to make the pulling capacity of these cylinders highly effective. The upper ends of the cylinders 36-36" are filled with a gas, such as nitrogen, and are connected to a small gas vessel 57, for prevention of moisture accumulating in the upper cylinder ends. The lower ends of the cylinders 36-36" comprise a hydraulic fluid such as oil and are connected via a valve 60 to the outlet of a piston type medium separator 58. An individual valve 60 may be provided for each respective cylinder 36, 36', 36". The medium separator 58 is connected to a hydraulic power unit 61 for filling or emptying the cylinders 36-36" and the medium separator 58 via the valves 62, 63 and for pressurizing the rod section of the cylinders 36-36" via the valve 62 with a pressure of several hundreds of bars for a final lifting stroke at the connection stage of the buoy 6. The valves 62, 63 and hydraulic power unit 61 may be controlled by the control unit 24.

The gas volume connected to the medium separator 58 is divided into a number of reservoirs 65, 66 each connected to a compressor 70 and each provided with a respective controllable valve 67, 68, which valves 67, 68 are connected to the control unit 24 via signal line 69 for selectively opening and closing of the valves. The reservoirs 68 are storage vessels at a pressure of for several hundreds of bars, the reservoirs 65, 66 being charged at stepwise increasing pressures of for instance a few bar, to several tens of bars.

The cylinders 36-36" and the medium separator 58 are connected to the control unit 24 for determining the cylinder stroke and separator mid position.

At larger depths of the mooring buoy 6, the static load on the cylinders 36-36" is relatively low and only the first of reservoirs 65 is connected to the upper end of the cylinders to result in a relatively low pressure of for instance 8 bar. The cylinders 36-36" are in balance and are able to absorb small impact loads required for the first pull-in phase. When the buoy 6 is lifted further, the static pressure at the rod side of the cylinders is increasing and the gas pressure generated by the reservoirs 65 is increased by successive opening of the valves 67 of those reservoirs 65 having increasing pressures. As the static load is more or less proportional with the lifting height of the buoy, opening of the valves 67 can be carried out by the control unit 24 in a linear manner. For any non-linearity in the load function, also the position of the cylinders measured by the sensor 71 is used in a position feedback control loop in the control unit 24. When the buoy 6 is lifted, the average position of the cylinders 36-36" changes, and the cylinders rods will be extended due to compression of the gas spring below the piston under higher vertical loads. Every time the average pressure in cylinders exceeds a certain threshold limit, the next gas reservoir 65 at a higher pressure is connected. In this embodiment, 5 reservoirs are used. Each reservoir is precharged at a predetermined number of bars higher pressure than the preceding reservoir.

The control unit 24 senses this change in average position and opens one or more of the valves 67, as a result of which the cylinders 36-36" return to their mid positions. The cylinders 36-36" should move around their mid positions. When the hydraulic pressure in the rod section of the cylinders 36-36" is larger than a predetermined threshold value, the gas pressure in the cylinder top ends is gradually reduced to a few bar.

The valve 60 is controlled by the control unit 24. When controlled to be in a closed position, the valve 60 acts as a check valve allowing only flow from the medium separator 58 towards the cylinders 36-36". This "ratchet" function is applied during the final pull-in phase of the buoy 6. The induced forces from the buoy due to the heave motions of the vessel are then used to allow only upwards movements of the cylinders and to lock any downward movement relative to the vessel.

Figure 9:
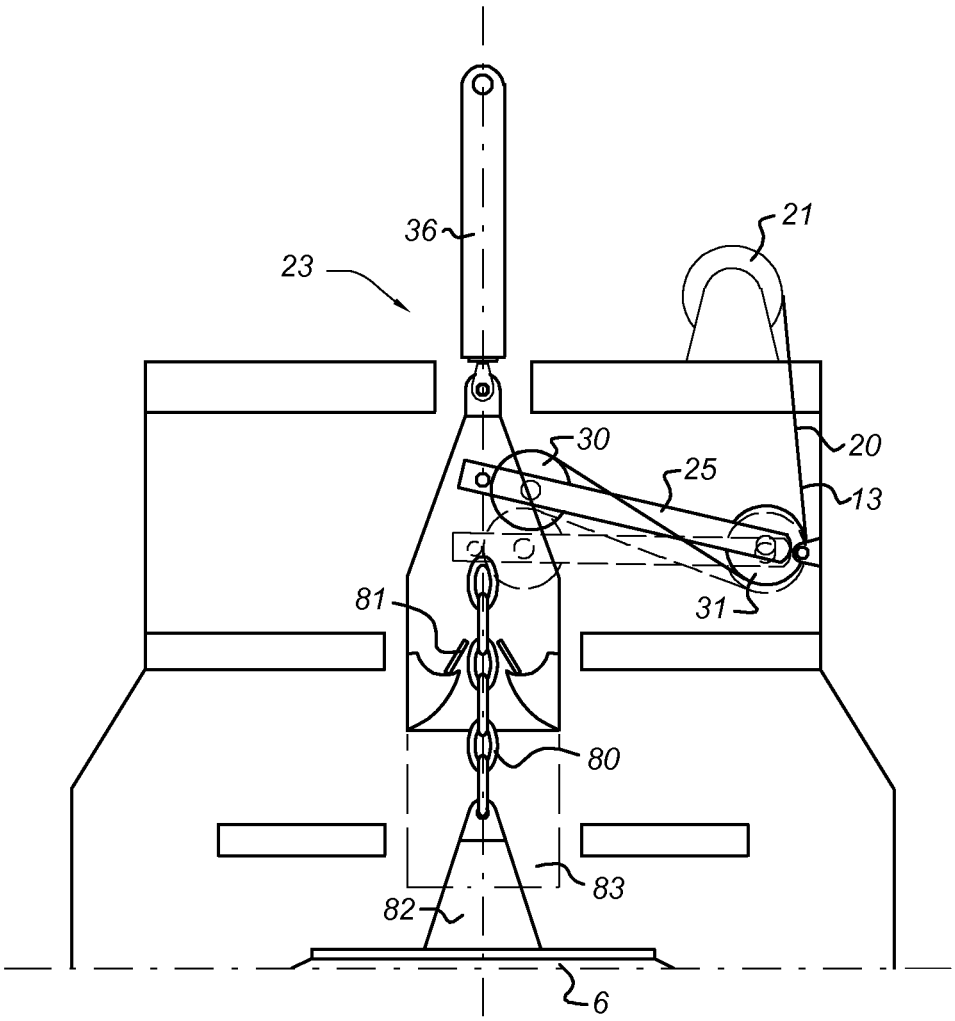
FIG. 9 shows an alternative embodiment of locking the buoy to the heave compensator member via a chain locker, in the connecting phase.

FIG. 9 shows an alternative embodiment of a heave compensating member 23 according to the invention, wherein in stead of a clamping connector, a chain stopper 81 is mounted on the free end of compensator arm 25 and in which the end part of the lifting cable 20 is formed by a chain section 80 attached to a connecting flange 82 that is fixed to the top 83 of the buoy 6. In the connect position, upon the final upward tilting movement of the compensator arm 25, the chain section 80 can pass only in an upward direction along the chain stopper 81 so that the buoy 6 is moved upwards in a 'ratchet' like manner until it can be fixed to the turret 13.

Figure 10:
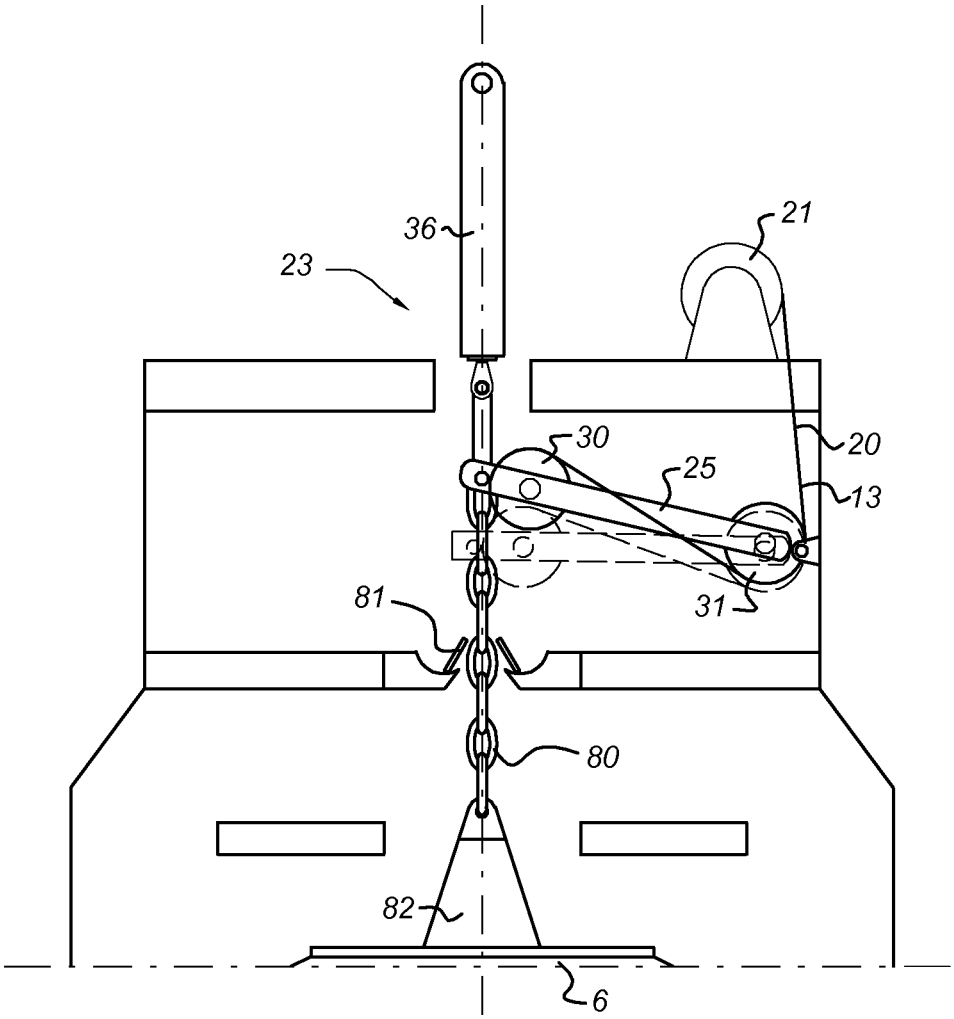
FIG. 10 shows an embodiment wherein no connector is provided on the free end of the heave compensator member, and FIG. 11 schematically shows an embodiment in which the contact area and the heave compensating member are situated outboard from the hull of the vessel.

In FIG. 10 an embodiment is shown in which no connector is mounted on the free end of the compensator arm 25, but in which the turret 13 is provided with a chain stopper 81 that is fixed to the turret 13.

Figure 11:
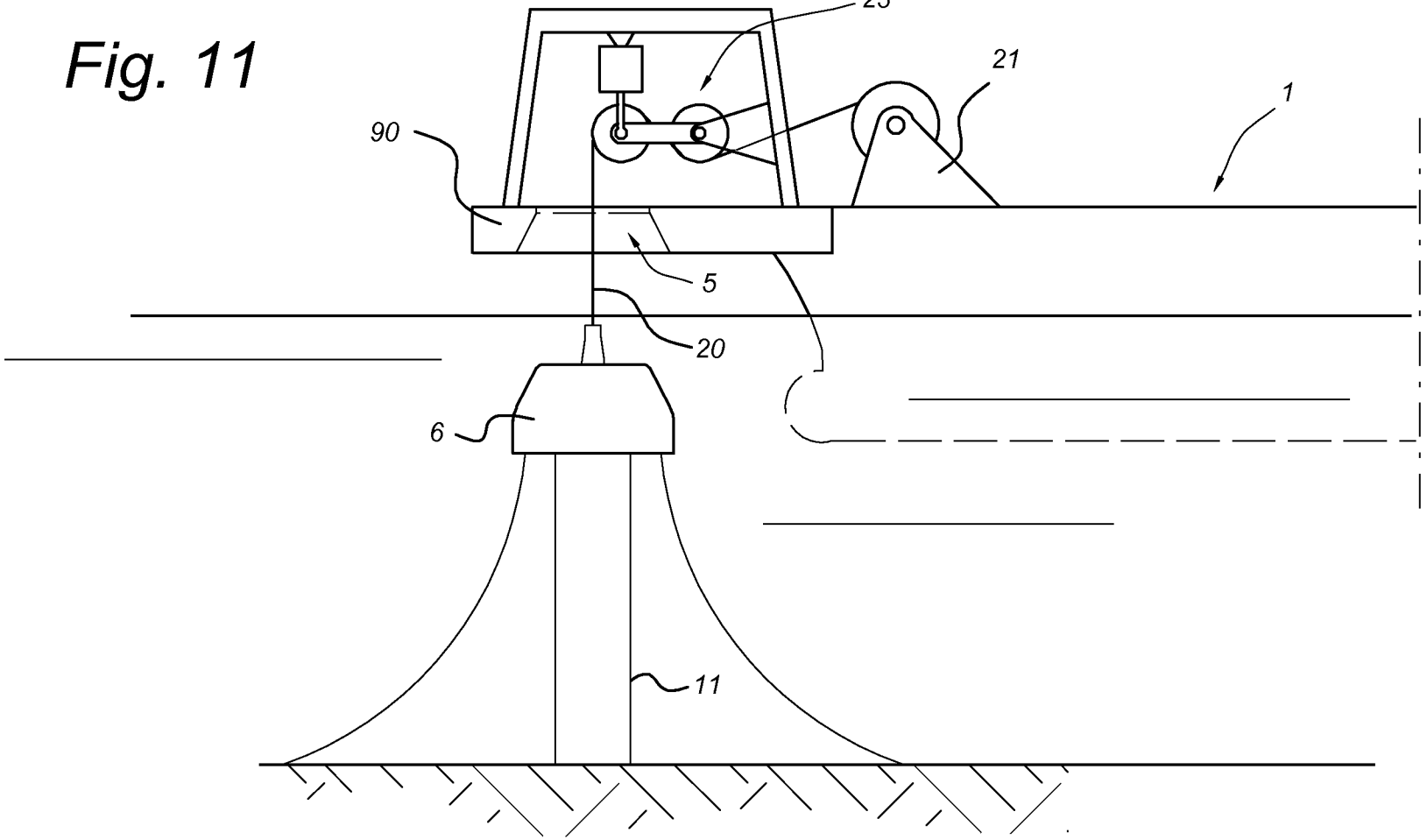

FIG. 11 shows an exemplary embodiment of a vessel 1 having at its bow an arm 90 extending beyond the hull the vessel and carrying the contact area 5 for the buoy 6 and the heave compensating member 23. Mooring structures for connecting a disconnectable buoy 6 externally of the hull are for instance described in detail in U.S. Pat. No. Re 32,578.

The invention claimed is:

1. Vessel (1) having a hull (3), a contact area (5) for attaching to a structure (6), a lifting device (21) on the vessel and a lifting cable (20) attached to the lifting device and extending along a heave compensating member (23) on the vessel and along a vertical lifting trajectory (35) to a connect position below keel level for attaching to the structure (6), a compensator arm (25) with a pivot end pivotally connected to a pivot point (27) on the vessel at a predetermined transverse distance from the vertical lifting trajectory (35), a cable guide element (30) being attached to a free end of the compensator arm (25) at or near the vertical lifting trajectory, guiding the lifting cable (20) in the direction of the pivot point (27), the arm (25) being at or near the free end connected to a displacement device (36, 36', 36") characterized in that the vertical lifting trajectory extends through the contact area (5), the lifting device and the cable (20) being adapted for lifting of the structure (6) to the contact area (5), the displacement device (36, 36', 36") being arranged substantially in line with the vertical lifting trajectory and being adapted for pivoting the arm up and down during operation of the lifting device (21) for heave compensation and for raising the arm at the stationary lifting device (21).

2. Vessel according to claim 1, wherein the structure (6) comprises a mooring structure (6), the contact area (5) being arranged at the hull near keel level (7) or externally of the hull (3) for attaching the vessel to the mooring structure.

3. Vessel (1) according to claim 1, wherein the lifting capacity of the displacement device (36, 36', 36") is at least 100 ton.

4. Vessel (1) according to claim 1, comprising a second cable guide element (31) that is situated near the pivot end of the compensator arm (25), the lifting cable (20) being guided from the first cable guide element (30) to the second cable guide element (31).

5. Vessel (1) according to claim 1, wherein during up and down movement of the arm (25) around the pivot point (27), at the stationary lifting device (21), the cable (20) at the first guide element (30) is substantially stationary relative to the first guide element (30).

6. Vessel (1) according to claim 1, wherein a connector (40) is attached to the free end of the arm (25) for engaging with a complementary connector (41) on a mooring structure (6) when it is connected to the lifting cable (20).

7. Vessel (1) according to claim 6, the connector (40) comprising locking jaws for fitting around a connecting rod (41) on a mooring structure (6), the lifting cable (21) passing through the locking jaws to the first guide element (30).

8. Vessel (1) according to claim 1, wherein a connector comprising a chain stopper (81) is attached to the hull, the lifting cable (20) near a mooring structure (6) being comprised of a chain section (80) for engaging with the chain stopper (81).

9. Vessel (1) according to claim 1, wherein the displacement device (23) comprises one or more fluid cylinders extending in a vertical direction, connected to the vessel above the compensator arm (25), at or near the vertical lifting trajectory (35).

10. Vessel (1) according to claim 1, wherein the displacement device (36, 36', 36") is connected to a displacement control unit (24) operating the displacement device in a heave compensating mode while the mooring structure (6) is lifted via the lifting cable (20) allowing upward and downward displacement of the compensator arm (25) at relatively low forces and which, after providing a fixed attachment of the mooring structure (6) to the arm (25), operates the displacement device (36, 36', 36") in a connector mode while the lifting device is stationary (21), displacing the displacement device (36, 36', 36") in an upward direction at a relatively large force to move the mooring structure (6) to a locking position.

11. Vessel (1) according to claim 10, wherein the displacement device comprises cylinders (36, 36', 36"), a number of gas reservoirs (65, 66) with increasing gas pressure being connected to a rod side of the cylinders (36, 36', 36") via respective valves (67, 68), the valves (67, 68) being controlled by the control unit (24), such that valves of reservoirs with increasing gas pressure are successively opened when the mooring structure (6) is lifted.

12. Vessel (1) according to claim 1, wherein the vessel comprises a receiving cavity (4) near keel level of the hull (3), for receiving a mooring buoy.

13. Vessel (1) according to claim 12, comprising a locking device (47, 48) for locking the mooring buoy (6) into the cavity (4).

14. Mooring system comprising a vessel (1) according to claim 13 and a mooring buoy (6), anchored to the sea bed (2) for connecting to the contact area (5).

15. Mooring system according to claim 14, wherein the mooring buoy (6) at a top surface (52) comprises a connecting rod (41) having a circumferential coupling member for engaging with locking jaws of a connector (40).

16. Mooring system according to claim 14, the mooring structure (6) comprising a buoy having a conical body, the buoy being anchored to the sea bed via catenary anchor lines (10), the contact area (5) comprising a receiving cavity (4) in the hull (3) of the vessel (1) for receiving the conical body.

17. Method of lifting a structure (6) from a subsea position through the water surface using a vessel according to claim 1, the method comprising the steps of:

lifting the cable (20) while the compensator arm (25) is in a substantially horizontal average position in a heave compensating mode to a predetermined connecting height, lifting the structure (6) from the connecting height by the arm (25) to a connect position via the displacement member (36, 36', 36") and contacting the structure (6) with the hull (3).

18. Method according to claim 17, wherein the compensator arm (25) is raised by allowing only upward motion caused by heave movements of the structure (6) relative to the vessel (1) and blocking downward displacement of the arm (25).

19. Method according to claim 17, wherein the structure is a mooring buoy attached to the sea bed, that is locked to the hull (3).

20. Vessel (1) according to claim 1, wherein the lifting capacity of the displacement device (36, 36', 36") is at least 1000 ton.

* * * * *